United States Patent [19]

Gross

[11] Patent Number: 4,465,431

[45] Date of Patent: Aug. 14, 1984

[54] OVERLOAD PROTECTION APPARATUS FOR VARIABLE PITCH PROPELLERS

[75] Inventor: Harald Gross, Herbrechtingen, Fed. Rep. of Germany

[73] Assignee: J. M. Voith GmbH, Heidenheim, Fed. Rep. of Germany

[21] Appl. No.: 391,645

[22] Filed: Jun. 24, 1982

[30] Foreign Application Priority Data

Jul. 3, 1982 [DE] Fed. Rep. of Germany ..... 3126188

[51] Int. Cl.[3] ..... B64C 11/06

[52] U.S. Cl. ..... 416/31; 416/43; 416/108; 416/156; 92/140; 74/104

[58] Field of Search ..... 416/31, 43 R, 108 A, 416/111 A, 156; 92/140; 74/104, 519, 512.5, 479

[56] References Cited

U.S. PATENT DOCUMENTS

| | | | |
|---|---|---|---|
| 3,241,618 | 3/1966 | Bear | 416/108 A |
| 3,700,349 | 10/1972 | Fork | 416/111 |
| 3,704,961 | 12/1972 | Fork et al. | 416/31 |
| 3,864,914 | 2/1975 | Timmins | 74/480 R |
| 4,348,156 | 9/1982 | Andrews | 416/49 |

FOREIGN PATENT DOCUMENTS

| | | | |
|---|---|---|---|
| 47808 | 8/1978 | Fed. Rep. of Germany | 416/156 |
| 2041144 | 9/1980 | United Kingdom . | |

*Primary Examiner*—Stephen Marcus
*Assistant Examiner*—John Kwon
*Attorney, Agent, or Firm*—Louis H. Reens; Thaddius J. Carvis

[57] ABSTRACT

Disclosed is an overload protection apparatus for variable pitch propellers, particularly cycloidal propellers. The apparatus is of the kind having a hydraulic servomotor (2) with an adjustment rod (1) for actuating a propeller, and having mechanical restoration means comprising an auxilliary adjustment means for adjusting a restoring lever (5) via an intermediate lever (6). As disclosed, the restoring lever (5) is pivotally linked to a first arm of the intermediate lever (6) which in turn is pivotally mounted on said adjustment rod (1) at a fulcrum (9). The first and second arms of the intermediate lever extend from opposite sides of the fulcrum. The second arm of the intermediate lever preferably includes a slideway (15) which receives a slide-shoe (16) affixed to an auxilliary adjustment lever (7), which is preferably an angular lever on which the auxilliary adjustment means acts at the end (12).

8 Claims, 3 Drawing Figures

OVERLOAD PROTECTION APPARATUS FOR VARIABLE PITCH PROPELLERS

Figure 1A:
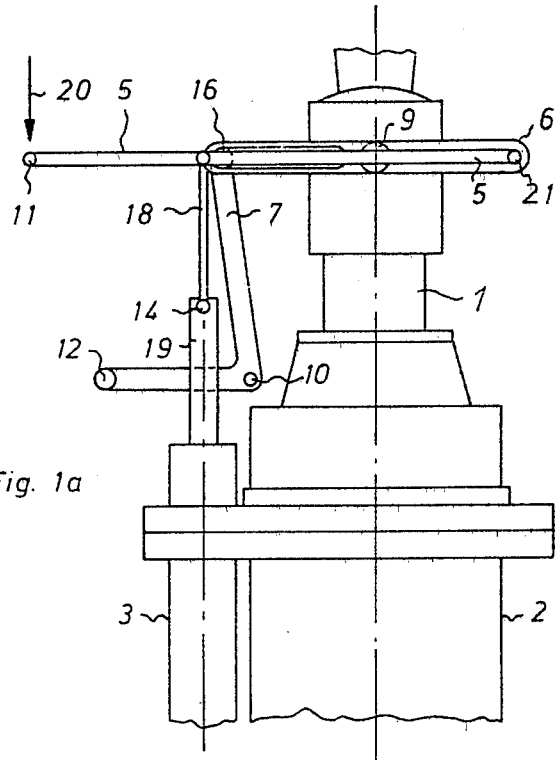

The invention relates to an overload protection apparatus for variable pitch propellers, and, particularly, to such an apparatus for use with cycloidal propellers employing a hydraulically positionable adjustment rod to adjust the pitch of the propeller blades and including mechanical restoration means responsive to an overload condition which actuate an intermediate lever to adjust a restoring lever for restoring the pitch to a non-overload condition.

A protection apparatus of this kind was disclosed in Great Britain Patent Specification No. 2,041,144. In that apparatus, the actuation of and the action on the restoring lever is effected mainly by means of hydraulically operating elements. This makes the device more expensive, and also increases its complexity and susceptibility to failure. In addition, the disclosed device does not always provide the desired degree of proportionality between the adjustment signal and the pitch restoration. That device employs a hydraulic position-sensing element and a hydraulic pressure transmitter with auxilliary servomotor action. Another drawback of that device is that the pitch can be adjusted in only one direction of travel. If used in the other direction, the exact opposite effect results.

It is an object of the present invention to provide an overload protection apparatus of comparatively simple construction and, therefore, having a low susceptibility to failure.

This and other objects are achieved according to at least the preferred embodiments of the invention. In its broad aspects, the invention provides an overload protection device of the kind employing a hydraulic servomotor with an adjustment rod for varying the pitch of the blades of variable pitch propellers, and mechanical restoration means including an auxilliary adjustment means responsive to an overload condition for actuating an intermediate lever to adjust a restoring lever for restoring the pitch to outside the overload range, wherein: the intermediate lever comprises first and second arms mounted on the adjustment rod about a fulcrum located between the arms, and the restoring lever is pivotally linked to the first arm and is thereby linked to the adjustment rod.

A particularly favorable embodiment of the invention further comprises a pivotally-supported auxilliary adjustment lever responsive to the auxilliary adjustment means, the pivotal support of which, in a neutral control position wherein the second arm is positioned substantially transverse to the axis of movement of the adjustment rod, is displaced from the longitudinal axis of the second arm; and has the auxilliary adjustment lever linked to the second arm by means of a slide-shoe which slidably engages an elongated slideway in the second arm, the second arm forming an angle with the auxilliary adjustment lever of at most 10° greater than a right angle in the neutral position. This embodiment enables influencing the direction of travel of a propeller powered craft, including forward and reverse as well as lateral steering directions (port and starboard) with a single auxilliary adjustment means. It is important for the operation of the apparatus of the invention that the length of the first and second lever arms and the length of the auxilliary adjustment lever from the pivotal support to the slide-shoe, be approximately the same, or, that the second lever arm be shorter than the length of the auxilliary adjustment lever from the pivotal support to the slide-shoe.

Figure 1B:
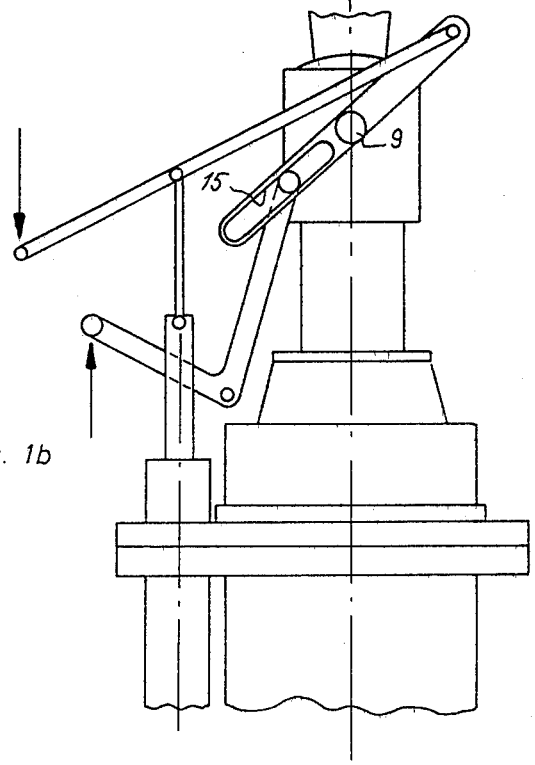
Figure 2:
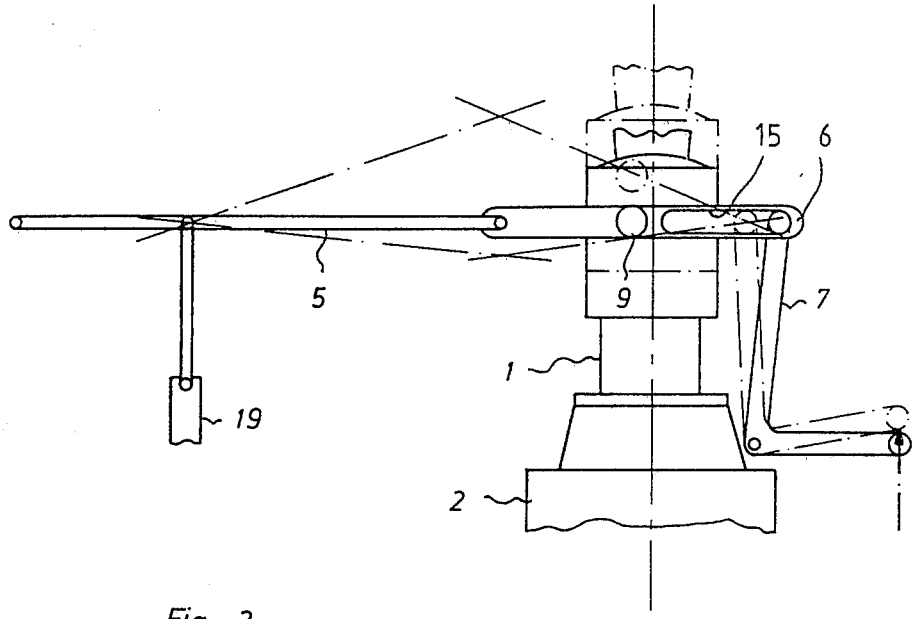

The present invention will be better understood and its advantages will become more apparent when the following detailed description is read in light of the accompanying drawings wherein:

FIGS. 1*a* and 1*b* schemtically show an apparatus according to the invention with a straight, two-armed intermediate lever; and FIG. 2 shows another embodiment of the invention with a similar intermediate lever, but wherein the linkage between the intermediate and restoring levers lies on one side of a plane defined by the fulcrum of the intermediate lever and the axis of movement of the adjustment rod of the servomotor, and the auxilliary adjustment means lies on the other side of the plane.

The Figures show only the mains features of the invention, and are restricted to the important parts covered by the invention. The auxilliary adjustment means for reducing the pitch and the other control device for producing the adjustment signals and imparting them to the restoring lever are omitted for the sake of simplicity, and correspond to the normal prior art. The parts shown in broken lines in FIG. 2 indicate the positions which they occupy when moved out of the neutral position shown with unbroken lines.

In FIGS. 1*a* and 2 the restoring lever is designated 5, and is connected via a link rod 18 to the piston rod 19 of the control element 3 of the servomotor 2. The restoring lever 5, on the end 11 of which the pitch adjustment signal 20 acts, is pivotally linked at 21 to a first arm of the intermediate lever 6, which in the exemplary embodiment is rotatably mounted on a fulcrum 9 which extends through approximately the central axis of the adjustment rod 1 of the servomotor 2. This adjustment rod 1 is used for varying the pitch of propeller blades and, in the exemplary case of cycloidal propellers, brings about the adjustment of the pitch of all the propeller blades by the same amount, via adjustment arms which are not shown here. In this exemplary situation, forward travel of a craft propelled by the propeller is brought about by moving the adjustment rod 1 upwardly in the plane of the Drawing (see FIG. 1*b*), and reverse travel by moving it downwardly in the plane of the Drawing.

Intermediate lever 6 is preferably substantially straight, having first and second arms disposed on opposite sides of fulcrum 9. The second arm of intermediate lever 6 has a slideway track 15 in which a slide-shoe 16 is guided as it slides. This shoe is fixed to the end of one arm of auxilliary adjustment lever 7 which is supported at a fixed pivotal support 10. Preferably, the auxilliary adjustment lever will be an angular lever, with two substantially straight portions which can be seen in the drawings to extend from the pivotal support at an angle to each other of from 70° to 80°. An angle of this magnitude provides the best possible linearity of the signal effect from the auxilliary adjustment means (not shown). The auxilliary adjustment means acts on the auxilliary adjustment lever 7 at 12 with its overload signal. The auxilliary adjustment lever 7 is rotated responsive to an overload by the auxilliary adjustment means, causing the intermediate lever 6 to pivot in the direction which simulates to the restoring lever 5 a greater stroke of the adjustment rod 1 than ordinarily exists. The effect of the adjustment signal on the propeller blades is thus reduced in the overload range.

In the exemplary embodiments shown in the Figures, the auxilliary adjustment lever 7 is longer than either of the two interlinked arms of the intermediate lever 6. And, as also seen in FIGS. 1*a* and 2, the length of the portion of lever 7 extending between the center of pivot 10 and the center of shoe 16, forms an angle somewhat smaller than a right angle with the longitudinal axis of the second arm of lever 6 when the apparatus is in the neutral position illustrated in FIG. 1*a* and in solid lines in FIG. 2. Preferably, this angle will not exceed a right angle by more than 10° in the neutral position. This makes it possible for the protective apparatus, employing a single auxilliary adjustment means for overload protection, to act against overloading in the same manner for both adjustment directions, i.e. for example, for both forward and reverse travel. The same is true with regard to FIG. 2, but in this case, as already indicated, unlike the embodiment shown in FIGS. 1*a* and 1*b*, the restoring lever 5 is linked to the side of the intermediate lever on which the control element 3 of the servomotor 2 is located. However, this does not significantly affect the method of operation.

The above description is for the purpose of describing the invention to the person skilled in the art. The description is not meant to describe in detail each and every obvious modification and variation of the invention which will become apparent to the skilled worker upon reading the description. It is intended, however, to include all such modifications and variations within the scope of the invention which is defined by the following claims.

I claim:

1. An overload protection device for propellers having variable pitch propeller blades, said device being of the kind employing a hydraulic servomotor, an adjustment rod actuatable by said servomotor for varying the pitch of the propeller blades, a restoring lever, an intermediate lever means operably engaged with said adjustment rod and said restoring lever, and mechanical restoration means including an auxilliary adjustment means responsive to an overload condition for actuating said intermediate lever to adjust said restoring lever for restoring the pitch to outside the overload range, wherein: said intermediate lever comprises first and second arms mounted on said adjustment rod about a fulcrum located between said arms, and said restoring lever is pivotally linked to said first arm and is thereby linked to said adjustment rod.

2. An overload protection device according to claim 1 which further comprises a pivotally-supported auxilliary adjustment lever responsive to said auxilliary adjustment means, the pivotal support of which, in a neutral control position wherein said second arm of said intermediate lever is positioned substantially transverse to the axis of movement of said adjustment rod, is displaced from the longitudinal axis of said second arm; and wherein said auxilliary adjustment lever includes a slide-shoe which links said auxilliary adjustment lever to said second arm by slidable engagement with an elongated slideway in said second arm, the angle formed between said second arm and said auxilliary adjustment lever being at most 10° greater than a right angle.

3. An overload protection device according to claim 2 wherein said pivotal support is displaced from said second arm, in said neutral control position, by a distance greater than the length of said second arm.

4. An overload protection device according to claim 2 wherein said auxilliary adjustment lever is an angular lever.

5. An overload protection device according to claim 4 wherein said auxilliary adjustment lever comprises two substantially straight portions extending from said pivotal support at an angle to each other of from 70° to 80°.

6. An overload protection device according to one of claims 1 to 5 wherein said intermediate lever is substantially straight and is linked to said restoring lever on one side of a plane defined by said fulcrum and the axis of movement of said adjustment rod, and said auxilliary adjustment means is positioned on the opposite side of said plane.

7. An overload protection device according to one of claims 1 to 5 wherein said intermediate lever in the neutral control position lies with its longitudinal axis exactly perpendicular to the axis of movement of said adjustment rod.

8. An overload protection device according to claim 6 wherein said intermediate lever in the neutral control position lies with its longitudinal axis exactly perpendicular to the direction of movement of said adjustment rod.

* * * * *